US007097486B2

(12) United States Patent
Parsons

(10) Patent No.: US 7,097,486 B2
(45) Date of Patent: Aug. 29, 2006

(54) LOW-COST WEATHERPROOF CABLE FEEDTHROUGH

(75) Inventor: Scott Parsons, Draper, UT (US)

(73) Assignee: Cushcraft Corporation, Manchester, NH (US)

( * ) Notice: Subject to any disclaimer, the term of this patent is extended or adjusted under 35 U.S.C. 154(b) by 0 days.

(21) Appl. No.: 11/050,222

(22) Filed: Feb. 3, 2005

(65) Prior Publication Data

US 2006/0172578 A1 Aug. 3, 2006

(51) Int. Cl.
*H01R 13/28* (2006.01)

(52) U.S. Cl. ..... 439/291; 439/462; 439/578

(58) Field of Classification Search ..... 439/291, 439/462, 578, 675, 322, 583–584, 447, 461, 439/470, 418, 463–464, 352, 676, 274, 564, 439/579, 580–582, 585
See application file for complete search history.

(56) References Cited

U.S. PATENT DOCUMENTS

| | | | | |
|---|---|---|---|---|
| 2,785,385 | A | 3/1957 | Figueira | 339/94 |
| 3,675,184 | A | 7/1972 | Vetter | 339/103 B |
| 3,954,319 | A | 5/1976 | Haines | 339/94 M |
| 4,304,455 | A | 12/1981 | McLaughlin et al. | 339/103 M |
| 4,421,373 | A | 12/1983 | Ratchford et al. | 339/94 M |
| 4,776,813 | A | 10/1988 | Wilson et al. | 439/587 |
| 4,797,122 | A | 1/1989 | Kuboi et al. | 439/589 |
| 4,932,882 | A | 6/1990 | Kang | 439/22 |
| 5,135,404 | A | 8/1992 | Clark | 439/106 |
| 5,299,949 | A | 4/1994 | Fortin | 439/275 |
| 5,482,299 | A | 1/1996 | Saito | 277/209 |
| 5,618,198 | A | 4/1997 | Sato et al. | 439/274 |
| 5,743,759 | A | 4/1998 | Pudims et al. | 439/462 |
| 6,164,997 | A | 12/2000 | Davies | 439/320 |
| 6,217,380 | B1 * | 4/2001 | Nelson et al. | 439/578 |
| 6,409,532 | B1 * | 6/2002 | Payson et al. | 439/320 |
| 6,514,096 | B1 | 2/2003 | Liu | 439/320 |
| 6,582,248 | B1 * | 6/2003 | Bachman | 439/462 |
| 6,817,902 | B1 * | 11/2004 | Bernardi et al. | 439/676 |
| 6,910,910 | B1 * | 6/2005 | Cairns | 439/352 |
| 2001/0036762 | A1 | 11/2001 | Payson et al. | 439/320 |
| 2003/0148652 | A1 * | 8/2003 | Bernardi et al. | 439/462 |
| 2004/0038578 | A1 | 2/2004 | Weigel et al. | 439/320 |

* cited by examiner

*Primary Examiner*—P. Austin Bradley
*Assistant Examiner*—Edwin A. Leon
(74) *Attorney, Agent, or Firm*—Hayes Soloway PC

(57) ABSTRACT

An assembly for providing a weatherproof feedthrough for data communications cables into a structure. The assembly includes a unique housing having a cavity for removably receiving a connector attached to a terminal end of a cable in a fixed orientation. The cable attached to the connector in the cavity exits the assembly into a protected side of the structure. A cable from the unprotected side of the structure enters the assembly such that a connector disposed on its terminal end may be connected to the connector in the cavity. The assembly is particularly suited to allow off the shelf connectors to be used within the housing. The assembly may include strain relief devices for protecting the cables attached to the connectors.

24 Claims, 4 Drawing Sheets

LOW-COST WEATHERPROOF CABLE FEEDTHROUGH

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

1. The Field of the Invention

The present disclosure relates generally to feedthroughs for data communication paths and more particularly, but not necessarily entirely, to feedthroughs for data communications cables that mount to a structure and provide a weather resistant passage through an aperture in the structure.

2. Description of Related Art

Feedthrough assemblies may provide a data communications path extending between the interior of a structure to a location outside of the structure. Often the interior of a structure is a protected environment while the exterior of the same structure is an unprotected environment subject to varying conditions, such as inclement weather, heat, dirt, sunlight and other conditions harmful to electrical components. In order to pass into a structure, a data communications path typically passes through an aperture formed in the structure itself. While the aperture provides an access into the structure for a data communications path, the aperture also may undesirably allow harmful substances into the protected confines of the structure.

Common types of data communications paths include single or multi-stranded cables and wires of all types, including coaxial cable, telephone wires, and computer cables such as CAT 5 cable. Other types of data communication paths may include fiber optical cable. A plethora of electrical connectors are commercially available for use with these data communication paths. For example, connectors used for computer cables are referred to as "RJ45" type connectors, which may include a male component, often referred to as a plug, and a female component, often referred to as a jack. The plug and the jack for RJ45 type connectors are inexpensive and may be field attachable to a CAT 5 wire to thereby allow the cables to be cut to the desired length.

In general, there are known previously available devices for providing protected connectors for electrical cables, some of which are discussed below.

In U.S. Patent Publication No. US2004/0038578 (published Feb. 26, 2004 to Weigel et al.), there is disclosed an electrical connector for a cable used in underground mining.

In U.S. Patent Publication No. US2003/0148652 (published Aug. 7, 2003 to Bernardi et al.), there is disclosed a plug device for a standard electrical connection cord that includes a cord plug having a body which includes an external mechanical latch fitted with a control lever.

In U.S. Pat. No. 6,582,248 (granted Jun. 24, 2003 to Bachman), there is disclosed a device for protecting a cable connector from damage or abuse during use.

In U.S. Pat. No. 6,514,096 (granted Feb. 4, 2003 to Liu), there is disclosed a connection for a rope light which is waterproof.

In U.S. Pat. No. 6,409,532 (granted Jun. 25, 2002 to Payson et al.), there is disclosed an in-line connector including a pre-molded connector body which provides a nesting region for an electrical connector.

In U.S. Pat. No. 6,164,997 (granted Dec. 26, 2000 to Davies), there is disclosed a device for protecting a multi-port electrical connection from inclement weather conditions.

In U.S. Pat. No. 5,743,759 (granted Apr. 28, 1998 to Pudims et al.), there is disclosed an electrical connector with a cord seal which is secured within the cord opening in the cover of the electrical connector.

In U.S. Pat. No. 5,618,198 (granted Apr. 8, 1997 to Sato et al.), there is disclosed an electrical connector which provides a waterproof connection.

In U.S. Pat. No. 5,482,299 (granted Jan. 9, 1996 to Saito), there is disclosed a device which provides a waterproof connector seal that includes a foldable cover sleeve to cover the plug body.

In U.S. Pat. No. 5,299,949 (granted Apr. 5, 1994 to Fortin), there is disclosed an electrical connector which includes an electrical connector with a sealing grommet suitable for use in the automobile industry.

In U.S. Pat. No. 5,135,404 (granted Aug. 4, 1992 to Clark et al.), there is disclosed an insulating liner for an electrical plug assembly which includes an insulating liner housed in a plug body that prevents electrical contact between the electrical connectors and the plug body.

In U.S. Pat. No. 4,932,882 (granted Jun. 12, 1990 to Kang), there is disclosed an electrical connector which includes rotary plug assembly that rotates with respect to a terminal end of a cable.

In U.S. Pat. No. 4,797,122 (granted Jan. 10, 1989 to Kuboi et al.), there is disclosed an electrical connector which is able to maintain air-tightness between an insert and a shell of the connector.

In U.S. Pat. No. 4,776,813 (granted Oct. 11, 1988 to Wilson et al.), there is disclosed an electrical connector and a sealed connector subassembly including a housing for receiving at least one terminal terminating a conductor, and a conductor entry seal and a connector cover.

In U.S. Pat. No. 4,421,373 (granted Dec. 20, 1983 to Ratchford et al.), there is disclosed an electrical connector having a means for sealing against moisture which included a spring biased operating sleeve operable to protect the electrical connector.

In U.S. Pat. No. 4,304,455 (granted Dec. 8, 1981 to McLaughlin et al.), there is disclosed an electrical connector which includes a terminal housing, a cap, and a sealing element.

In U.S. Pat. No. 3,954,319 (granted May 4, 1976 to Haines), there is disclosed an electrical connector assembly which includes a totally hermaphroditic connection to thereby protect the electrical contacts of the electrical connection.

In U.S. Pat. No. 3,675,184 (granted Jul. 4, 1972 to Vetter), there is disclosed a resilient seal for a backshell that also serves as an anchor for a cable to thereby prevent an unintentional uncoupling of the electrical connection.

In U.S. Pat. No. 2,785,385 (granted Mar. 12, 1957 to Figueira), there is disclosed a moisture proof electrical connector for a central conductor surrounded by an insulating material.

It is noteworthy that none of the previously known devices discussed above provides a combination feedthrough and weather proof housing for an electrical connector. Thus, despite the features of known apparatuses, some of which are discussed above, improvements are still being sought. The prior art is thus characterized by several disadvantages that are addressed by the present disclosure. The present disclosure minimizes, and in some aspects eliminates, the failures known in the art, and other problems, by utilizing the methods and structural features described herein.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
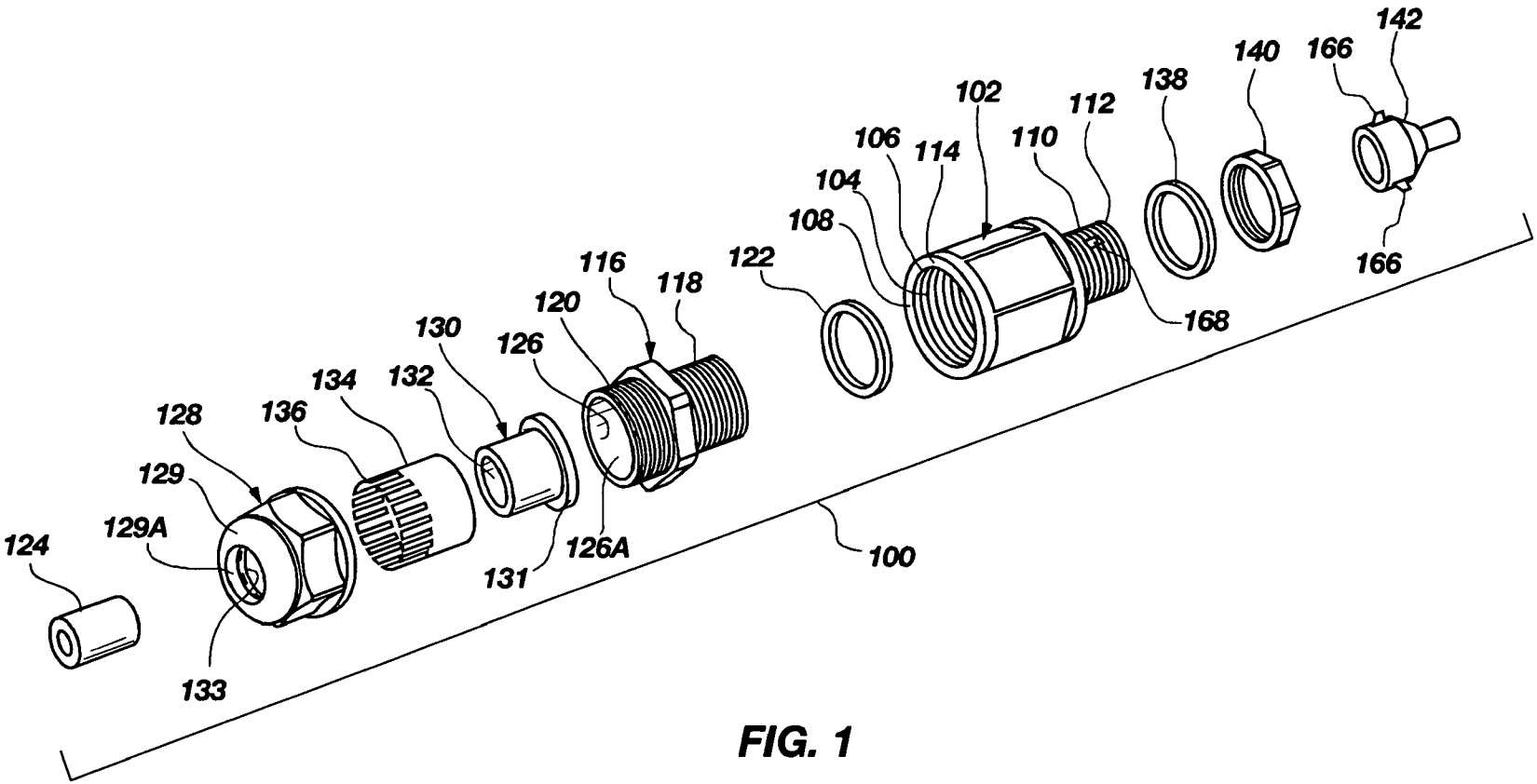
FIG. 1 is an exploded view of an exemplary embodiment of the present invention.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms "a," "an," and "the" include plural referents unless the context clearly dictates otherwise.

In describing and claiming the present disclosure, the following terminology will be used in accordance with the definitions set out below. As used herein, the terms "comprising," "including," "containing," "characterized by," and grammatical equivalents thereof are inclusive or open-ended terms that do not exclude additional, unrecited elements or method steps. As used herein, the term "proximal" shall refer broadly to the concept of a nearest portion. As used herein, the term "distal" shall generally refer to the opposite of proximal, and thus to the concept of a further portion, or a furthest portion, depending upon the context.

Applicant has discovered a low cost and weather resistant feedthrough assembly that also provides a protected housing for a connection between a connector on the terminal end of a cable and a connector on the terminal end of another cable. The feedthrough assembly may be attachable to a structure such that a cable may be passed from the outside or unprotected side of the structure to the inside or protected side of the structure. The feedthrough assembly may also be characterized by its low cost and ease of installation.

Referring now to FIG. 1, the is shown an exploded view of an exemplary embodiment of a feedthrough assembly 100. The feedthrough assembly 100 comprises a housing 102 having a threaded bore 104 extending into the housing 102 from an opening 106 on its proximal end 108. The housing 102 further includes a male threaded extension 110 on its distal end 112. A passageway through the housing 102 connects the opening 106 on the proximal end to an opening (not explicitly shown) on the distal end 112. An annular rim 114 is disposed around the opening 106 on the proximal end 108 of the housing 102.

A coupler 116 includes a first male threaded extension 118 and a second male threaded extension 120. The first male threaded extension 118 is sized and configured to threadably engage the threaded bore 104 in the housing 102. A resilient member 122, such as an O-ring, may be used to form a fluid resistant seal at the point where the first male threaded extension 118 engages the threaded bore 104. The resilient member 122 is interposed between the coupler 116 and the annular rim 114 of the housing 102. As the coupler 116 is tightened against the housing 102, the resilient member 122 is operable to form a fluid resistant connection between the coupler 116 and the housing 102.

The second male threaded extension 120 on the coupler 116 includes a cylindrical cavity 126. The second male threaded extension 120 is sized and configured to threadably engage a threaded interior (not explicitly shown) of a sealing nut 128. The sealing nut 128 includes an opening 133 for allowing a cable to enter into the feedthrough assembly 100. The sealing nut 128 further includes a domed portion 129 having a concave surface 129A on its interior.

The cylindrical cavity 126 in the second male threaded extension 120 on the coupler 116 is adapted to receive a packing material 130 having a casing 134 mounted thereon. The casing 134 includes flexible fingers 136 that are deformable when engaged by the concave surface 129A on the interior of the domed portion 129 of the sealing nut 128. The packing material 130 may include a posterior rim 131 and a hollow passage 132. The posterior rim 131 may form a seal against an interior sidewall 126A of the cylindrical cavity 126. The posterior rim 131 may also engage the rearmost surface of the casing 134. A resilient sleeve member 124 may also be used to improve a seal between a cable entering the sealing nut 128 and the packing material 130. The resilient sleeve member 124 may be slid over a cable such that it encases a portion of the cable that extends through the packing material 130.

The feedthrough assembly 100 may further include a resilient member 138 mountable on the male threaded extension 110 on the distal end 112 of the housing 102. A nut 140 may also threadably engage the male threaded extension 110 on the distal end 112 of the housing 102. The male threaded extension 110, the resilient member 138, and the nut 140 may be utilized to mount the feedthrough assembly 100 to a structure 150 (shown in FIG. 2) as will be explained hereinafter. The resilient member 138, such as an o-ring, may be utilized to form a fluid resistant seal between the housing 102 and the structure 150. A strain relief 142 may mount onto the male threaded extension 110 as will also be further explained hereinafter.

It will be appreciated that the structure and apparatus disclosed herein is merely one example of a means for forming a fluid resistant seal, and it should be appreciated that any structure, apparatus or system for forming a fluid resistant seal which performs functions the same as, or equivalent to, those disclosed herein are intended to fall within the scope of a means for forming a fluid resistant seal, including those structures, apparatus or systems for forming a fluid resistant seal which are presently known, or which may become available in the future. Any structure which functions the same as, or equivalently to, a means for forming a fluid resistant seal is to fall within the scope of this element.

Figure 2:
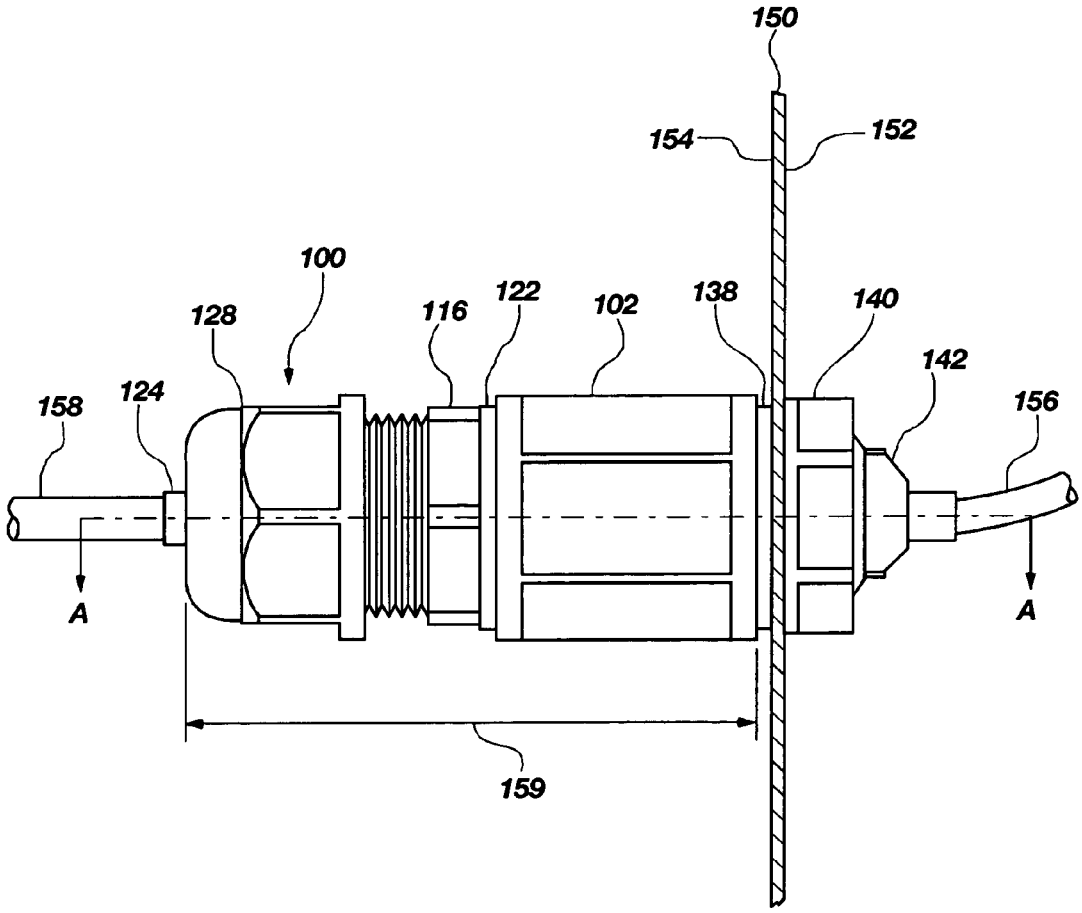
FIG. 2 is an external side view of the exemplary embodiment of the present invention shown in FIG. 1 when assembled.

Referring now to FIG. 2, there is shown an assembled feedthrough assembly 100 mounted on a structure 150, the structure having a protected side 152 and an unprotected side 154. As used herein, the term "structure" means any man-made article through which it may be desirable to pass a data communications path, including, without limitation, a panel, an edifice, a wall, a box, and any type of support formed of any material. Although not explicitly shown in FIG. 2, the structure 150 may include an aperture through which the male threaded extension 110 of the housing 102 may be inserted. The resilient member 138 is interposed between the structure 150 and the housing 102. The nut 140 threadably engages the male threaded extension 110 of the housing 102 from the protected side 154 of the structure to thereby secure the assembly 100 to the structure 150. As the nut 140 is tightened, the resilient member 138 is slightly deformed to create a fluid resistant seal between the housing 102 and the structure 150.

It will be appreciated that the nut 140 and the male threaded extension 110 is one example of a member operable to attach the housing 102 to the structure 150. Other types of members known to those skilled in the art may be employed to attach the housing 102 to the structure, including, without limitation, the use of a threaded aperture in a structure, or a snap-type connection. It will be further appreciated that the structure and apparatus disclosed herein is merely one example of a means for connecting a feedthrough assembly to a structure, and it should be appreciated that any structure, apparatus or system for connecting a feedthrough assembly to a structure which performs functions the same as, or equivalent to, those disclosed herein are intended to fall within the scope of a means for connecting a feedthrough assembly to a structure, including those structures, apparatus or systems for connecting a feedthrough assembly to a structure which are presently known, or which may become available in the future. Anything which functions the same as, or equivalently to, a means for connecting a feedthrough assembly to a structure falls within the scope of this element.

A first cable 156 may be inserted into the housing 102 from the protected side 152 of the structure 150. Attached to a terminal end of the cable 156 may be a connector 157 (see FIG. 3). A second cable 158 may be inserted into the housing 102 from the unprotected side 154 of the structure 150. The second cable 158 may have the resilient sleeve member 154 over the portion corresponding to the packing material 130. Attached to the terminal end of the cable 158 may be another connector 159 (see FIG. 3). The strain relief 142 may be employed to thereby prevent the depletion of the useful life of the cable 156 due to forces acting on the cable 156.

The entire portion of the assembly 100 on the unprotected side 154 of the structure 150 may be about three (3) inches (7.62 centimeters) long. It will be appreciated that this length is illustrative and not limiting. This length is indicated by the double arrows marked with the reference numeral 159. It will be further noted that housing 102, nut 140, coupling 116, and sealing nut 128 may each include a portion having a hexagonal cross section. The hexagonal cross section of each of these components permits the use of wrenches and the like to be used with each of these components to thereby facilitate the installation of the assembly 100.

Figure 3:
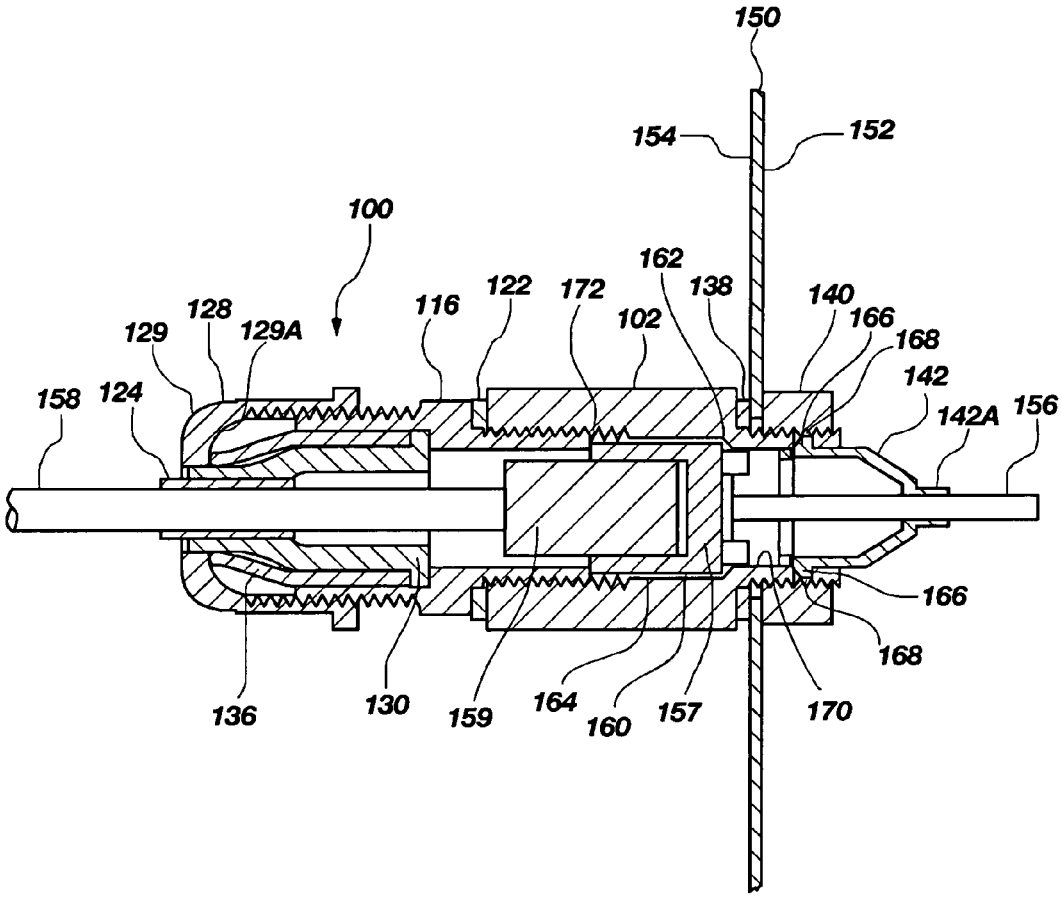
FIG. 3 is a sectional view taken along the plane A—A shown in FIG. 2.

FIG. 3 is a cross-sectional view of the assembled feedthrough assembly 100 along the section A—A shown in FIG. 2. As can be seen, the housing 102 includes an interior cavity 160 for receiving connector 157. The cavity 160 is located in the hollow passageway through the interior of the housing 102. The threaded bore 104 may form part of the hollow passageway through the housing 102 such that the threaded bore 104 is interposed between the cavity 160 and the opening 106 on the proximal end 108 of the housing 102. The cavity 160 may be configured and dimensioned for removably receiving connector 157.

It will be appreciated that the structure and apparatus disclosed herein is merely one example of a means for enclosing an electrical connection, and it should be appreciated that any structure, apparatus or system for enclosing an electrical connection which performs functions the same as, or equivalent to, those disclosed herein are intended to fall within the scope of a means for enclosing an electrical connection, including those structures, apparatus or systems for enclosing an electrical connection which are presently known, or which may become available in the future. Anything which functions the same as, or equivalently to, a means for enclosing an electrical connection falls within the scope of this element.

Still referring to FIG. 3, a first wall 164 of the cavity 160 may engage the connector 157 to thereby hold the connector 157 in a fixed orientation. Generally speaking, the cavity 160 may be formed to be approximately the same shape as the connector 157, but just slightly larger such that the connector 157 may be removably received into the cavity 157 by a snug fit.

It will be appreciated that the structure and apparatus disclosed herein is merely one example of a means for receiving a connector in a fixed orientation, and it should be appreciated that any structure, apparatus or system for receiving a connector in a fixed orientation which performs functions the same as, or equivalent to, those disclosed herein are intended to fall within the scope of a means for receiving a connector in a fixed orientation, including those structures, apparatus or systems for receiving a connector in a fixed orientation which are presently known, or which may become available in the future. Anything which functions the same as, or equivalently to, a means for receiving a connector in a fixed orientation falls within the scope of this element.

The cavity 160 may include an annular and chamfered surface 162 located at a rear portion of the cavity 160. The annular and chamfered surface 162 may extend inwardly into the cavity 160 to thereby prevent the connector 157 from being able to pass completely through the housing 102. In this manner, the annular and chamfered surface 162 may only allow the connector 157 to be installed into the cavity 160 through the opening 106 on the proximal end 108 of the housing 102. A rear portion of the connector 157 may abut against the annular and chamfered surface 162.

It will be appreciated that the annular and chamfered surface 162 is merely one form of a contacting surface that may be utilized with the present invention to thereby impede the movement of a connector in the hollow passage of a housing. The contacting surface may be integrally formed into a housing. The contacting surface may include, without limitation, all types of projections, lips, surfaces and other means for physically impeding the movement of a connector in a hollow passage of a housing.

It will be appreciated that the structure and apparatus disclosed herein is merely one example of a means for maintaining a connector in the fixed orientation, and it should be appreciated that any structure, apparatus or system for maintaining a connector in the fixed orientation which performs functions the same as, or equivalent to, those disclosed herein are intended to fall within the scope of a means for maintaining a connector in the fixed orientation, including those structures, apparatus or systems for maintaining a connector in the fixed orientation which are presently known, or which may become available in the future. Anything which functions the same as, or equivalently to, a means for maintaining a connector in the fixed orientation falls within the scope of this element.

As previously mentioned, as shown best in the sectional view of FIG. 3, the strain relief 142 is connected to the male threaded extension 110 of the housing 102. The strain relief 142 may include a pair of resilient members 166 each having a lip for engaging a corresponding recess 168 formed in an interior sidewall 170 of the male threaded extension 110. The strain relief 142 may thus be connected by a snap fit to the housing 102. The strain relief 142 may engage the cable 156 may a crimp fit on the rear portion 142A of the strain relief.

The connector 157 may be held in the cavity 160 by the first male threaded extension 118 on the coupler 116. In particular, a rim 172 on the first male threaded extension 118 may engage the connector 157 as the first male threaded extension 118 is rotatably inserted into the threaded bore 104 of the housing 102. The rim 172 on the first male threaded extension 118 may slightly compress the connector 157 between itself and the annular and chamfered surface 162.

The connector 159 disposed on the terminal end of cable 158 may form a connection with connector 157 while connector 157 is installed into cavity 160. The connection between connector 157 and 158 may be entirely contained in the hollow passageway in the housing 102.

A compression seal around the cable 158 and the resilient sleeve member 124 may be formed as the sealing nut 128 is installed onto the second male threaded extension 120 of the coupler 116. The concave surface 129A on the interior of the domed portion 129 of the sealing nut 128 may deform the flexible fingers 136 radially inward such that the packing material 130 is forced against the resilient sleeve member 124 and cable 158 to thereby form a fluid resistant seal against the resilient sleeve member 124 and the cable 158. As more torque is applied to the sealing nut 128, the tighter the compression seal will become between the packing material 130, resilient sleeve member, and the cable 158. It will be further appreciated that the sealing nut 128 in combination with the packing material 130 also forms a strain relief for the cable 158. As previously mentioned, the strain relief is operable to protect the cable 158 and the electrical connection between connectors 157 and 159.

It will be noted that the sealing nut 128, the packing material 130, the casing 134 and the second male threaded extension 120 on the coupler 116 form a cable sealing assembly that is operable to form a fluid resistant seal around a cable entering the assembly 100 from the unprotected side 154 of the structure 150. One advantage to using this type of cable sealing assembly is that its component parts are available for low cost and are widely available. This results in lowering the costs of producing the present invention.

It will be further appreciated that the structure and apparatus disclosed herein is merely one example of a means for sealing around a cable, and it should be appreciated that any structure, apparatus or system for sealing around a cable which performs functions the same as, or equivalent to, those disclosed herein are intended to fall within the scope of a means for sealing around a cable, including those structures, apparatus or systems for sealing around a cable which are presently known, or which may become available in the future. Anything which functions the same as, or equivalently to, a means for sealing around a cable falls within the scope of this element.

Figure 4:
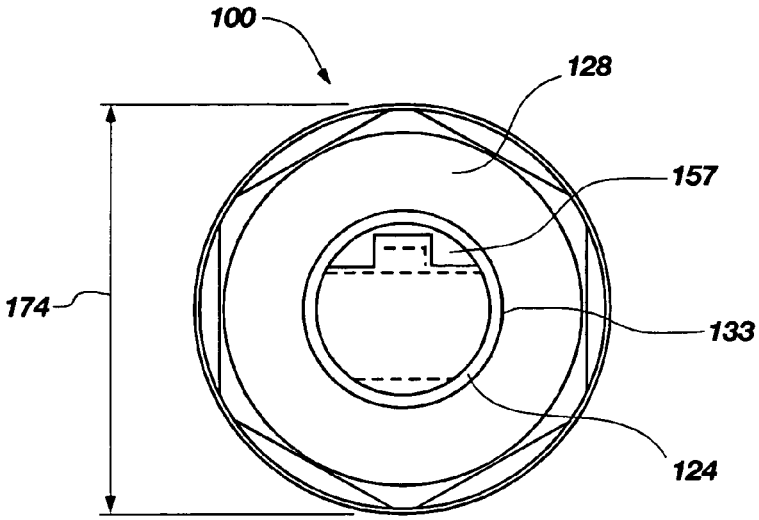
FIG. 4 is a view of the proximal end of the exemplary embodiment shown in FIG. 1 when assembled.

Referring now to FIG. 4, there is shown an end view of the proximal end of the feedthrough assembly 100. The proximal end of the feedthrough assembly is that end that is intended to be positioned on the unprotected side 154 of the structure 150. For explanatory purposes, the connector 157 is shown in the cavity 160, but it should be recognized that the connector 157 in the illustrative embodiment is removable from the housing 102. In fact, one primary benefit to the present invention is that the connectors 157 and 159 are not integrated into any part of the assembly 100. This feature allows the assembly 100 to be manufactured for less cost than traditional feedthrough assemblies. Further the connectors 157 and 159 may be ordinary off the shelf type connectors that are commercially available, thus providing the desirable features described herein at much lower cost than previously available. Because the connectors 157 and 159 may be off the shelf type connectors, the present invention eliminates the expensive manufacturing costs associated with feedthrough devices having one or both of the connectors integrated or molded into the feedthrough itself. For example, a plug and a jack for RJ45 type connectors are inexpensive and widely available. The ability to use these commercially available connectors results in much lower costs for a user.

Figure 5:
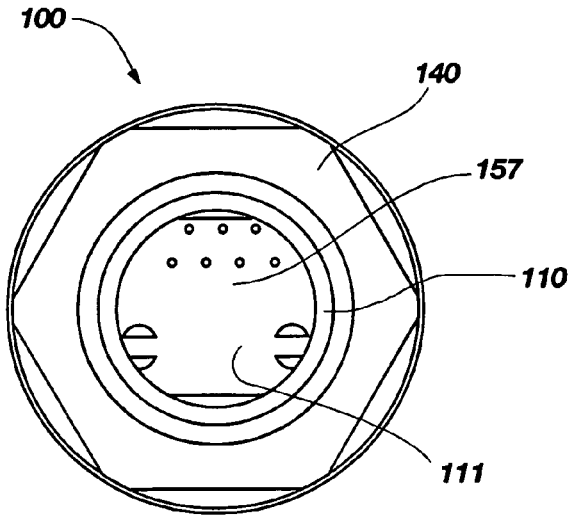
FIG. 5 is a view of the distal end of the exemplary embodiment shown in FIG. 1 when assembled.

The height of the illustrative assembly 100 may be about one (1) inch (2.54 centimeters). This height is indicated by the double arrows marked with the reference numeral 174 in FIG. 4. It will be appreciated that the height is merely illustrative and not limiting. As can be observed, the opening 133 in the sealing nut 128 allows access to the interior of the assembly 100 from the unprotected side 152 of the structure 150. FIG. 5 illustrates an end view of the distal end of the feedthrough assembly 100 without the strain relief 142 installed. An opening 111 in the distal end 112 of the male threaded extension 110 provides access to the cavity 160 in which connector 157 may be installed.

Those having ordinary skill in the relevant art will appreciate the advantages provided by the features of the present disclosure. For example, it is a feature of the present disclosure to provide a weather resistant feedthrough assembly for a data communications path. Another feature of the present disclosure to provide such a low-cost feedthrough assembly and electrical connection housing for RJ45 type connectors. It is a further feature of the present disclosure, in accordance with one aspect thereof, to provide an electrical feedthrough assembly having an internal cavity for removably receiving an off-the-shelf electrical connector.

It will be understood that the present invention may be employed with various types of data communication paths both of an electrical or optical nature, including single or multi-stranded cables and wires of all types, including coaxial cable, telephone wires, and computer cables such as CAT 5 cable. Other types of data communication paths may include fiber optical cable.

In addition, the assembly 100 may be adapted for use with a wide variety of electrical connectors. For example, connectors used for computer cables are referred to as "RJ45"

type connectors, which may include a male component, often referred to as a plug, and a female component, often referred to as a jack. The plug and the jack for RJ45 type connectors are inexpensive and may be field attachable to a CAT 5 wire to thereby allow the cables to be cut to the desired length. For example, connector 157 may be an RJ45 jack while connector 159 may be an RJ45 plug. Thus, it should be understood that as used herein, the term "connector" refers to any device attachable to a terminal end of a cable that is connectable to a corresponding device on the terminal end of another cable to thereby complete a data communication path between the two cables. Further, the connectors may be field attachable to the cables.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An electrical feedthrough device for passing a data communications path from an unprotected side of a structure to a protected side of the structure through an aperture in the structure, the device comprising:

a base unit having a proximal end and a distal end;

a cavity formed within the base unit, the cavity being configured and dimensioned for enclosing an electrical connection between a first electrical connector attached to a terminal end of a first cable and a second electrical connector attached to a terminal end of a second cable;

a first passage located within the base unit and extending from an opening located on the proximal end of the base unit to the cavity;

a second passage located within the base unit and extending from the cavity to an opening located on the distal end of the base unit;

a cable sealing assembly located on the base unit for sealing against a cable passing into the first passage from the opening on the proximal end of the base unit; and a member located on the distal end of the base unit for removably mounting the base unit to the structure such that the second passage is in alignment with the aperture in the structure, the member comprising a male threaded extension, the male threaded extension being sized to fit through the aperture in the structure such that a nut is installable onto the male threaded extension from the protected side of the structure.

2. The electrical feedthrough device of claim 1 further comprising a resilient member for forming a fluid resistant seal between the distal end of the base unit and the structure.

3. The electrical feedthrough device of claim 1 wherein the cavity is further configured and dimensioned for removably receiving one of the first electrical connector or the second electrical connector in a fixed orientation.

4. The electrical feedthrough device of claim 1 further comprising a strain relief device for protecting a cable extending through the second passage and into the structure.

5. The electrical feedthrough device of claim 1 wherein the cable sealing assembly comprises a compression ring, a cylindrical packing material, and a resilient sleeve member.

6. The electrical feedthrough device of claim 1 wherein the base unit comprises a first portion, the first portion having a hexagonal cross section.

7. The electrical feed through device of claim 1 wherein the cavity is configured and dimensioned for enclosing a RJ45 plug and a RJ45 jack to thereby establish an electrical connection between a CAT 5 cable entering the base unit from the unprotected side of the structure and a CAT 5 cable exiting the base unit into the protected side of the structure.

8. The electrical feedthrough device of claim 7 wherein the cavity is further configured and dimensioned for removably receiving the RJ45 jack in a fixed orientation.

9. An electrical feedthrough device for passing a data communications path from an unprotected side of a structure to a protected side of the structure through an aperture, the device comprising:

a housing having a proximal end and a distal end;

a pair of openings on the housing, one of the openings disposed on the proximal end of the housing and one of the openings disposed on the distal end of the housing;

a cavity formed within the housing, the cavity being configured and dimensioned for enclosing an electrical connection between a first electrical connector attached to a terminal end of the a first cable and a second electrical connector attached to a terminal end of a second cable;

a threaded bore extending from the opening on the proximal end of the housing towards the cavity;

an exit passage leading from the cavity in the housing to the opening on the distal end of the housing;

a member located on the distal end of the housing for removably mounting the housing to the structure such that the second passage is in alignment with the aperture in the structure; and a hollow coupler having a first portion and a second portion, the first portion of the coupler comprising a male threaded extension operable to threadably engage the threaded bore in the housing, and the second portion of the coupler comprising a cable sealing assembly for sealing against a cable.

10. The electrical feedthrough device of claim 9 wherein the member comprises a male threaded extension and a nut, the male threaded extension being sized to fit through the aperture in the structure such that the nut is installable onto the male threaded extension from the protected side of the structure.

11. The electrical feedthrough device of claim 9 further comprising a resilient member for forming a fluid resistant seal between the distal end of the housing and the structure.

12. The electrical feedthrough device of claim 9 wherein the cavity is further configured and dimensioned for removably receiving one of the first electrical connector and the second electrical connector in a fixed orientation.

13. The electrical feedthrough device of claim 9 further comprising a strain relief for protecting a cable extending through the exit passage and into the structure.

14. The electrical feedthrough device of claim 9 wherein the cable sealing assembly comprises a male threaded extension, a compression ring and a cylindrical packing material.

15. The electrical feedthrough device of claim 9 wherein at least a portion of the housing comprises hexagonal cross section.

16. The electrical feedthrough device of claim 9 further comprising an annular resilient member, the annular resilient member being installable on the male threaded extension of the hollow coupler, the annular resilient member being operable to form a fluid resistant seal between the hollow coupler and the housing.

17. The electrical feedthrough device of claim 9 wherein the cavity is configured and dimensioned for enclosing a RJ45 plug and an RJ45 jack to thereby establish an electrical connection between a CAT 5 able entering the housing from the unprotected side of the structure and a CAT 5 cable exiting the housing into the protected side of the structure.

18. The electrical feedthrough device of claim 17 wherein the cavity is further configured and dimensioned for removably receiving the RJ45 jack in a fixed orientation.

19. A method of installing a cable feedthrough assembly on a structure having an aperture, the method comprising the steps of:

providing a housing having a pair of openings interconnected by a hollow passage extending through the housing;

attaching the housing to an unprotected side of the structure such that the hollow passage is in alignment with the aperture;

threading a terminal end of a first cable through the aperture and the housing from a protected side of the structure;

attaching a first electrical connector to the terminal end of the first cable;

providing a cable sealing assembly having a terminal end of a second cable passing through a hollow passage in the cable sealing assembly, the terminal end of the second cable having a second electrical connector attached thereto;

forming an electrical connection by mating the first electrical connector and the second electrical connector together; and installing the cable sealing assembly on the housing.

20. The method of claim 19 wherein the first electrical connector and the second electrical connector are RJ45 connectors.

21. The method of claim 19 wherein the step of providing a cable sealing assembly further comprises the step of attaching the second electrical connector to the terminal end of the second cable.

22. The method of claim 19 wherein the cable sealing assembly is threadably installed onto the housing.

23. The method of claim 19 further comprising the step of installing a strain relief to protect the first cable.

24. The method of claim 19 wherein the housing further comprising a cavity for removable receiving the first electrical connector in a fixed orientation.

* * * * *

UNITED STATES PATENT AND TRADEMARK OFFICE

CERTIFICATE OF CORRECTION

PATENT NO. : 7,097,486 B2
APPLICATION NO. : 11/050222
DATED : August 29, 2006
INVENTOR(S) : Parsons It is certified that error appears in the above-identified patent and that said Letters Patent is hereby corrected as shown below:

Column 11, Claim 17, Line 19, “able” should be --cable--

Signed and Sealed this

Fifth Day of December, 2006

JON W. DUDAS
*Director of the United States Patent and Trademark Office*